United States Patent [19]

Berg et al.

[11] Patent Number: 4,541,526

[45] Date of Patent: Sep. 17, 1985

[54] FOLDED CARTON BEVERAGE ACCESSORIES DISPENSER

[76] Inventors: Lloyd T. Berg, 41 Westmere Dr., Des Plaines, Ill. 60016; Stephen A. Flowers, 8508 W. Lisa La., Hickory Hills, Ill. 60457

[21] Appl. No.: 608,667

[22] Filed: May 10, 1984

[51] Int. Cl.[4] ..... B65D 85/62

[52] U.S. Cl. ..... 206/44.12; 229/17 R; 221/306; 312/43

[58] Field of Search ..... 206/44, 44.12; 229/17; 221/306, 63, 305; 312/43

[56] References Cited

U.S. PATENT DOCUMENTS

| | | | |
|---|---|---|---|
| 1,778,248 | 10/1930 | Doughty | 312/43 |
| 1,915,341 | 6/1933 | Walker et al. | 206/44.12 |
| 2,323,841 | 7/1943 | Pape et al. | 221/306 |
| 3,160,274 | 12/1964 | Pritchard | 206/44 B |
| 3,258,114 | 6/1966 | King | 206/44.12 |

*Primary Examiner*—William T. Dixson, Jr.
*Attorney, Agent, or Firm*—Gary, Juettner & Pyle

[57] ABSTRACT

A dispenser for beverage accessories such as cups, napkins, individual packages of coffee, tea, sugar and creamers etc., and stirrers have been provided and may be connected to a bag in the box type beverage server to make a neat, attractive display which is easy to set up and clear away. Preferably the dispenser is made from a paper products carton blank and can be provided with a shelf and internal dividers dividing the dispenser into suitable compartments.

9 Claims, 9 Drawing Figures

FOLDED CARTON BEVERAGE ACCESSORIES DISPENSER

DESCRIPTION

1. Field Of The Invention

This invention relates to a folded carton dispenser, and more particularly a folded carton dispenser which may be used in conjunction with a beverage server to hold drinking cups, napkins and other beverage accessories.

2. Brief Description Of The Prior Art

Heretofore, it has become common place to offer non-carbonated drinks, such as milk, wine and coffee in what is known as a bag in a box type server. Such type server is fitted with a manually controlled spout through which the drink contained in the bag may be dispensed. Due to the convenience of having no bottles to break, return or dispose of, this type server has become popular, especially for parties and with catering services serving such groups. However, while the beverage dispenser was convenient, there still was the need for attendant accessories, such as plastic or paper cups, napkins, stirrers, individual packages or servings of sugar, creamer, instant coffee or tea (for use with a hot water dispenser), etc. All this additional paraphernalia had to be supplied, and usually was in its own cumbersome containers. As a result, the bag in the box server was usually surrounded by a myriad of boxes, containers, stacks of cups and napkins, etc., creating a virtual clutter. Not only was the clutter unsightly, but it created extra work in setting it up and clearing it away.

SUMMARY OF THE INVENTION

The folded carton beverage accessories dispenser of the present invention has eliminated the foregoing disadvantages, and preferably comprise a carton blank which can be quickly and easily folded into a beverage accessories dispenser that can conveniently hold the cups, napkins, stirrers and other above mentioned accessories required with and accompanying a beverage server. In addition, the accessories dispenser of the present invention can be actually attached to the beverage server to form a self-contained unit, thus, providing both the beverage and the needed accessories. The folded carton beverage accessories dispenser of the present invention, thus greatly simplifies set up before a party, and clean up thereafter, and makes a much more attractive arrangement and display.

It is a primary object of the present invention to provide an inexpensive folding carton type beverage accessories dispenser for use with a bag in box type beverage server.

It is another object of the present invention to provide a folding carton dispenser that can hold caps, napkins, stirrers and other beverage accessories.

Yet another object of the present invention is to provide a folded carton beverage dispenser which is easier to set up and easier to clear away while presenting a better appearance than what was done in the prior art.

These and other objects and advantages of the folding carton beverage accessories dispenser of the present invention will become apparent from the accompanying figures of the drawings and the following written description.

DESCRIPTION OF THE PREFERRED EMBODIMENTS

Figure 1:
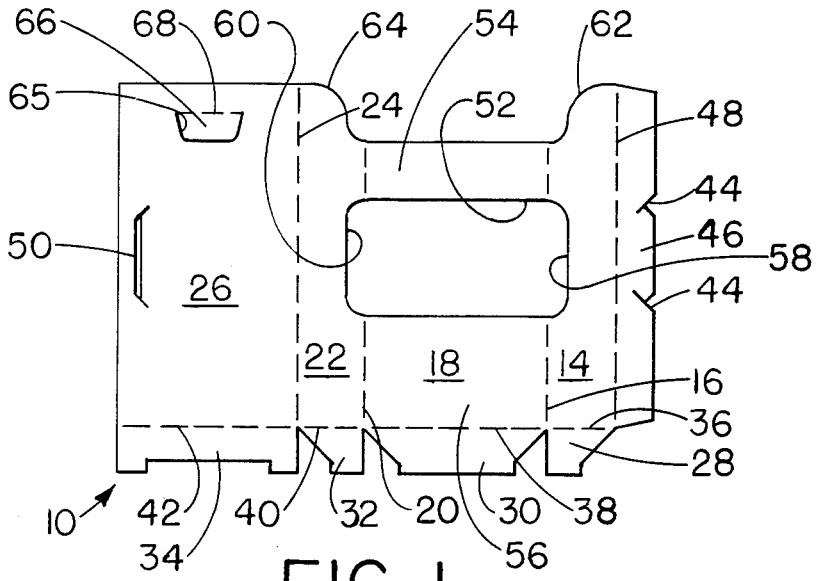
FIG. 1 is a plan view of the carton blank for the first embodiment of the present invention.
Figure 2:
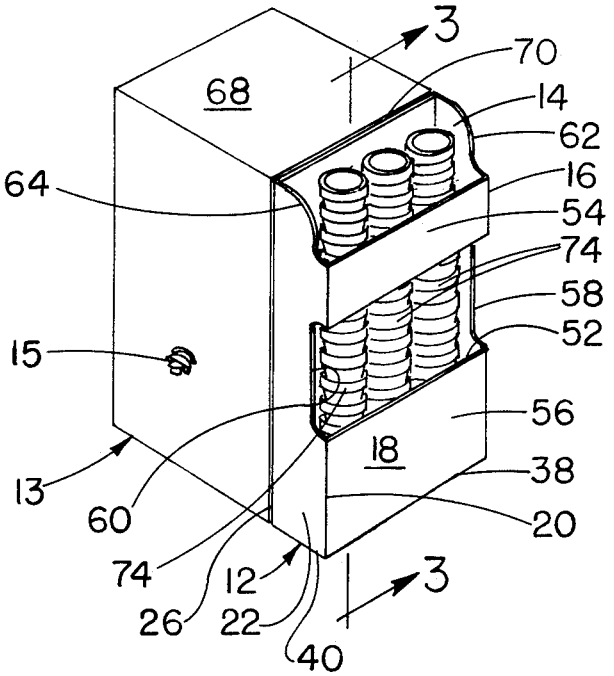
FIG. 2 is a perspective view of the assembled carton blank shown in FIG. 1, holding stacks of cups and affixed to a bag in box beverage server.

Referring to FIG. 1, a first embodiment folding carton blank 10 of the present invention is illustrated for forming the first embodiment of accessories beverage dispenser 12 of the present invention, shown assembled in FIG. 2 and connected to a conventional bag in the box type beverage server 13 (having a spout 15) with which it is to be used.

Starting from the right side of FIG. 1, the carton blank 10 has a first side panel 14 which is connected across a fold line 16 to a front panel 18, which in turn, is connected across a fold line 20 to a second side panel 22, which in turn is connected across another fold line 24 to a back panel 26. As is illustrated each of the panels 14, 18, 22 and 24 carries bottom forming tabs 28, 30, 32 and 34, respectively, which cooperate with each other in a known and conventional manner to form the bottom of the dispenser when the tabs 28, 30, 32 and 34 are folded at their respective fold lines 36, 38, 40 and 42 and interlocked.

The first side panel 14 and back panel 26 have means for connecting these two panels together. This connecting means comprises a pair of angularly cut lines 44 on either side of and forming a center tab 46 on the margin of the first side panel 14 opposite its fold line 48 and a cooperating opening 50 formed in the back panel 26. When the carton blank 10 is folded and assembled with the center tab 46 engaged in the opening 50, they hold the back panel and first side panel together.

A large access opening 52 is formed in at least the front panel 18 to permit access to the beverage accessories which are to be placed within the assembled dispenser. Preferably this access opening 52 is at least the width of the front panel and one-half or more of its height, with preferably one-sixth of the height, indicated by reference numeral 54, above the access opening and one-third of the height, indicated by reference numeral 56, below the access opening. To further increase access to and visibility of the accessories to be placed inside, the access opening 52 can wrap around or extend into the first and second side panels 14 and 22, as is indicated at 58 and 60, respectively. As is illustrated the tops of the first and second side panels, as indicated at 62 and 64, curves downward from the higher height of the back panel 26 to the height of the lower front panel 18, again providing improved access and visibility to the accessories, while yet containing them in place.

The folding blank 10 also has means for retaining or securing the assembled beverage dispenser to the bag in the box beverage server 13. Preferably, the retaining means takes the form of a "u" shaped opening 65 and tab 66 cut into the back panel 18, the tab 66 being connected across a fold line 68.

Figure 3:
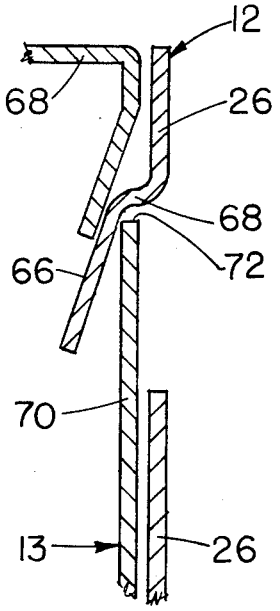
FIG. 3 is an enlarged cross-sectional view taken along the line 3—3 of FIG. 2, showing the interconnection of the beverage accessories dispenser to a beverage server.

This "u" shaped opening 65 forms a handle for the dispenser 12, and the tab 66 functions to hold the same to the bag in the box server 13. Referring to FIG. 3, the bag in the box server has a top wall 68 and side wall 70, and contains a handle cutout 72 in the latter. As can be seen the tab 65 of the dispenser 12 is pushed into interlocking relationship into the cutout 72 to hold and hang the dispenser 12 on the server 13.

As is shown in FIG. 2, the dispenser 12 may be filled with drinking accessories such as disposable cup stacks 74 and then sent out with a beverage server 13. At the site the accessories dispenser 12 can then be connected to the server 13, as in the manner shown and described in conjunction with FIG. 3, to form a neat and convenient unit for dispensing both beverage and cups.

Figure 4:
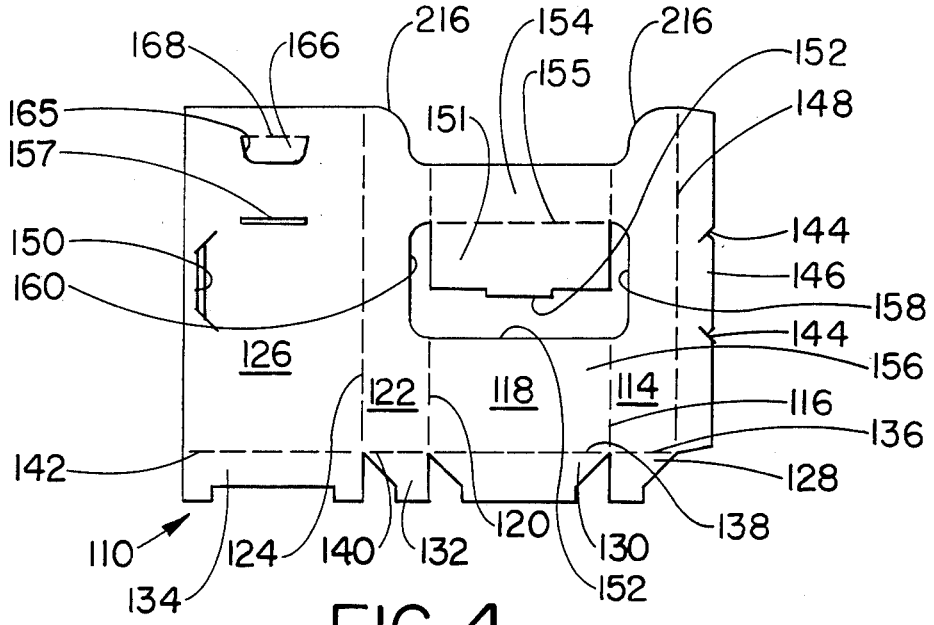
FIG. 4 is a plan view of the carton blank for a second embodiment of the present invention.
Figure 8:
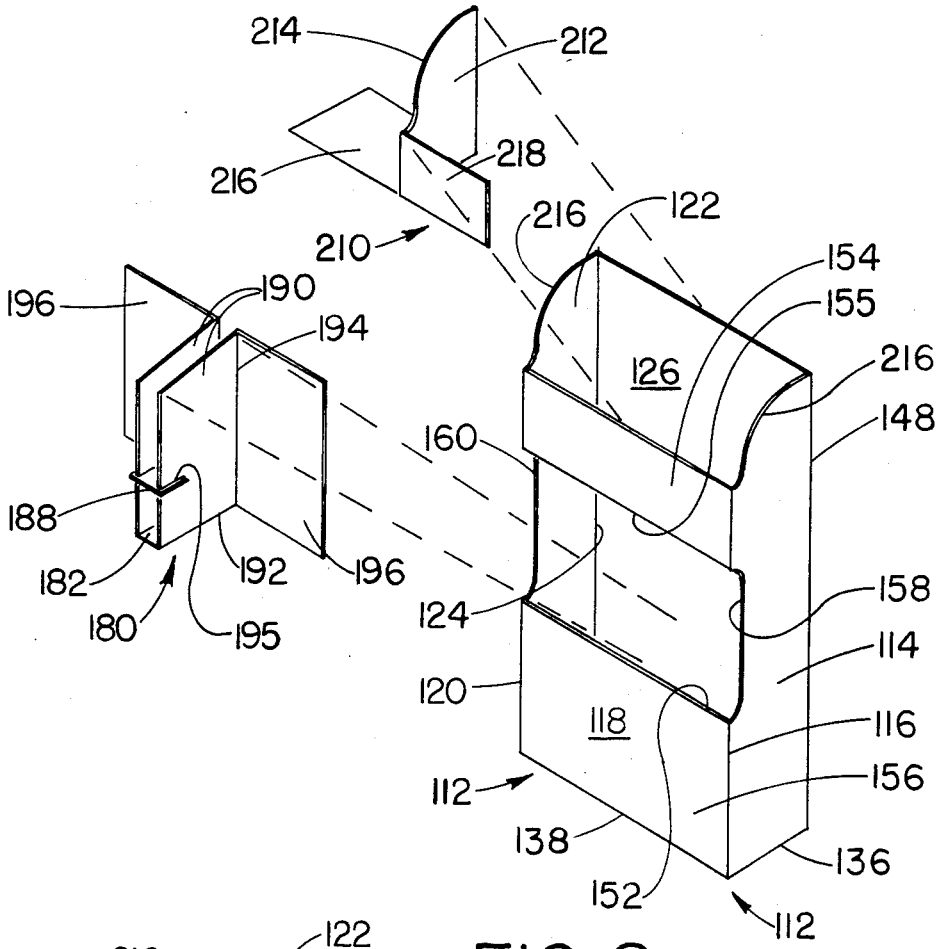
FIG. 8 is an exploded view showing the carton blank of FIG. 4 assembled and the first and second auxiliary carton blanks of FIGS. 5 and 6 bent to their final shape.
Figure 9:
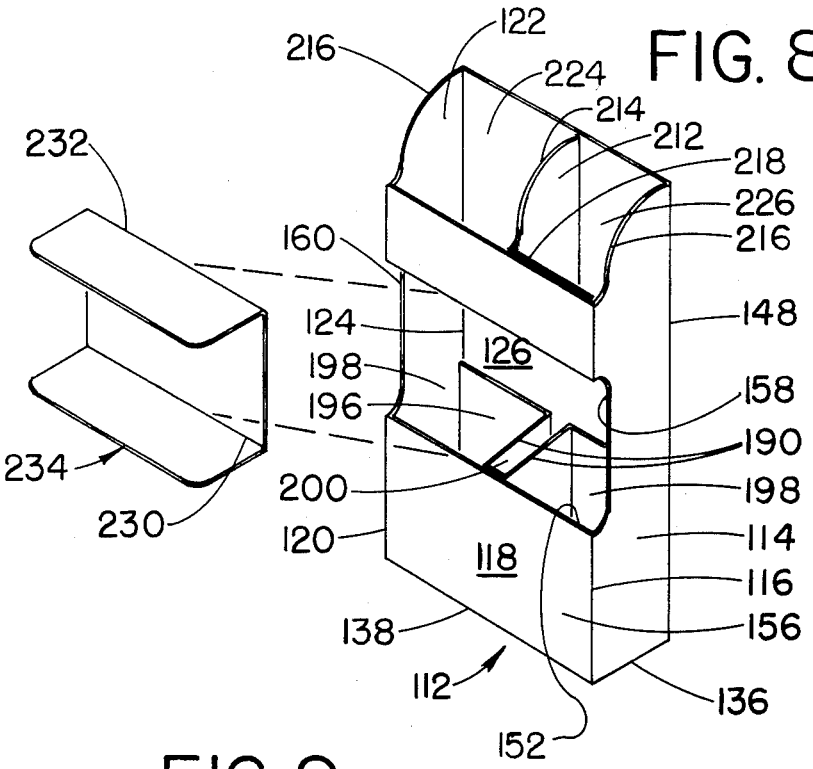
FIG. 9 is an assembled view of the carton shown in FIG. 8 with the third auxiliary carton blank of FIG. 7 shown in a displaced position.

Referring to FIG. 4, a second embodiment folding carton blank 110 of the present invention is illustrated for forming a second embodiment of accessories beverage dispenser 112 of the present invention, shown assembled in FIGS. 8 and 9, and could also be connected to a conventional bag in the box beverage server 13.

Starting from the right side of FIG. 4, the carton blank 110 has a first side panel 114 which is connected across a fold line 116 to a front panel 118. The front panel 118, in turn, is connected across a fold line 120 to a second side panel 122, which in turn is connected across another fold line 124 to a back panel 126. As is illustrated, each of the panel 114, 118, 122 and 124 carries bottom forming tabs 128, 130, 132 and 134, respectively, which cooperate with each other in a known and conventional manner to form the bottom of the dispenser when the tabs 128, 130, 132 and 134 are folded at their respective fold lines 136, 138, 140 and 142 and interlocked.

The first side panel 114 and back panel 126 have means for connecting these two panels together. This connecting means comprises a pair of angularly cut lines 144 on either side of and forming a center tab 146 on the margin of the first side panel opposite its fold line 148 and a cooperating opening 150 formed in the back panel 126. When the carton blank 110 is folded and assembled with the center tab 146 engaged in the opening 150, it holds the back panel and first side panel together.

A large access opening 152 is formed in at least the front panel 118 to permit access to the beverage accessories which are to be placed within the assembled dispenser. Preferably, this access opening 152 is at least the width of the front panel and one-half or more of its height, with one-sixth of the height, indicated by reference numeral 154, or so above the access opening and one-third of the height, indicated by reference numeral 156, or so below the access opening. To further increase access to and visibility of the accessories, the access opening can wrap around or extend into the first and second side panels, as is indicated at 158 and 160, respectively.

Depending from the front panel 118 and extending toward the lower edge of the access opening is a shelf tab 151 which at its lower edges has locking tab 153. When assembling, the shelf tab 151 is folded across line 155, and its locking tab 153 is engaged in an opening or slit 157 provided in the back panel 126 to hold the shelf.

The folding blank 110 also has means for retaining or securing the assembled beverage dispenser to the bag in the box beverage server 13. Preferably, the retaining means takes the form of a "u" shaped opening 165 and tab 166 cut into the back panel 126, the tab 166 being connected across a fold line 168. This "u" shaped opening 165 forms a handle for the dispenser 112, and the tab 166 functions to hold the same to the bag in the box server 13, in the same manner dispenser 12 is held in place.

Figure 5:
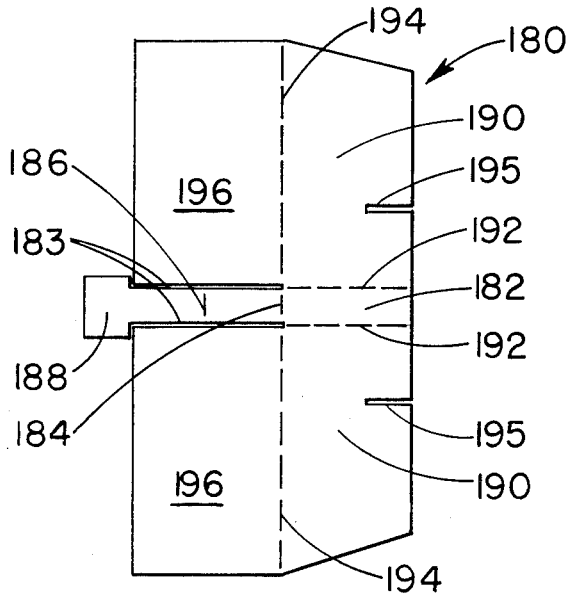
FIG. 5 is an enlarged, plan view of a first auxiliary carton blank for the second embodiment of the present invention.

Referring to FIG. 5, to provide dividers and a different height shelf, the dispenser 12 or 112 can be provided with a first auxiliary folding blank 180 which has a center tab 182 formed by two cuts 183 part way therethrough, having two fold lines 184 and 186, and an enlarged head portion 188. Extending from the center portion 182 are a pair of wings 190 which fold at fold lines 192 and then again at fold lines 194. Each of the wings 190 has a slot 195 to accommodate the head portion 188.

The manner in which blank 180 is folded to form the dividers and higher shelf is shown in FIG. 8. The two wings 190 are folded parallel to each other, and the center portion 182 is twice bent on lines 184 and 186 so that the head 188 engages in the two slots 195. Then the outer portions 196 of the wings 190 are folded at ninety degrees (90°) across fold lines 194 to the shape shown in FIG. 8. As is shown in FIGS. 8 and 9, the folded first auxiliary blank 180 may then be inserted into the dispenser 112, or 12 for that matter, to rest upon the bottom. In this position the bottom is divided into three compartments, two side compartments 198 and a higher floor, center compartment 200 (center tab 182 forming the bottom thereof). This higher, center compartment 200 is ideal for holding short items, such as stirrers, while the two compartments 198 can be used, say for individual packages of sugar, coffee, tea or creamer.

Figure 6:
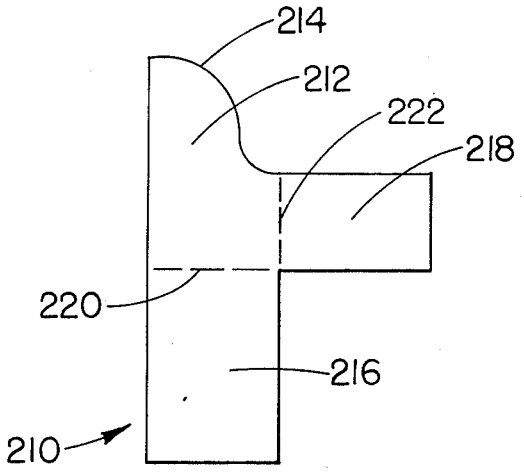
FIG. 6 is an enlarged, plan view of a second auxiliary carton blank for the second embodiment of the present invention.

Referring to FIG. 6, a second auxiliary blank 210 is shown, and it too provides a divider, but for the shelf formed by the shelf tab 151. The blank 210 has a center portion 212 with a top edge 214 cut similarly to that of the top edges 216 of the embodiment 112. From the center 212 extend two wings, 216 for the bottom, and 218 for the front panel, the wings being folded along lines 220 and 222, respectively. With the second auxiliary blank 210 folded as shown in FIG. 8, it may then be inserted into the dispenser 112 on its shelf 151, to divide the top shelf into two compartments 224 and 226, which can hold napkins.

Figure 7:
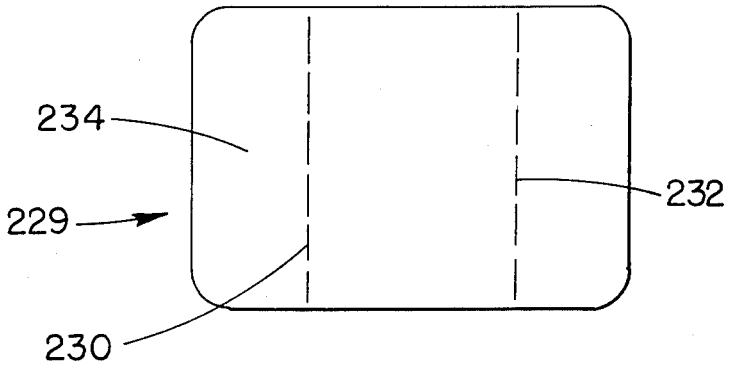
FIG. 7 is an enlarged, plan view of a third auxiliary carton blank for the second embodiment of the present invention.

Referring to FIG. 7, the small blank 229 cutout from blank 10 to form the access opening 52 of embodiment 12, may be folded at lines 230 and 232, as shown in FIG. 9, to form a security or retaining panel 234 to hold and retain the individual packages of sugar, coffee, tea and creamer and stirrers in place in compartments 198 and 200 during shipment. The security panel 234, of course, would be removed when the server 13 and the two accessories dispensers 12 and 112 are set up. The panel 234 can then be placed under the server 13 and used as a spill tray.

The dispenser 112 may be filled with drinking accessories such as napkins, individually packages of creamer and sugar, etc., and then sent out with a dispenser 12 and server 13. At the site the dispensers 12 and 112 can then be connected as in the manner shown and described in conjunction with FIG. 3 to form a neat and convenient unit for serving a beverage and dispensing cups, napkins, etc.

Of course, an accessories dispenser of the present invention could be made of other materials than paper or cardboard, such as metal or plastic. Also, just one accessories dispenser could be used or they could be used in pairs, in conjunction with a bag in the box type beverage server. While the preferred embodiments were described as holding cups, napkins, stirrers and individual packages of coffee, tea, sugar or creamer, they also could be used for any other beverage accessories.

While two preferred embodiments of accessories dispensers of the present invention have been illustrated and described, from the foregoing it should be understood that variations, modifications and equivalent structures thereof fall within the scope of the appended claims.

What is claimed is:

1. A folding carton blank for forming a disposable dispenser for at least one of a plurality of disposable stacks of cups and other beverage accessories, said dispenser being used with and adapted to be connected to one side of a bag in the box type beverage server, said folding carton blank comprising a first generally rectangular side panel having a vertical fold line, first locking means one side of said vertical fold line of said first side panel, a horizontal fold line on said first side panel, a first bottom forming tab on the bottom side of said horizontal fold line, a generally rectangular front panel connected to said first side panel at the side of said vertical fold line opposite said first locking means, said front panel having an access opening therein of a width substantially that of said front panel, of a height at least one-half the height of said front panel and greater than that of one of the cups so that a cup may be removed therethrough, said front panel having a second horizontal fold line, a second bottom forming tab on the bottom side of said second horizontal fold line on said front panel, a generally rectangular second side panel connected to said front panel, a third horizontal fold line on said second side panel, a third bottom forming tab on the bottom side of said third horizontal fold line on said second side panel, a generally rectangular back panel connected to said second side panel, a fourth horizontal fold line on said back panel, a fourth bottom forming tab on the bottom side of said fourth horizontal fold line on said back panel, cooperating locking means on said back panel aligning and engaging with said first locking means on said first side panel to hold said first side and back panels together to form the dispenser when said carton blank is assembled, said two side panels and said back panels being of a height substantially that of the bag in the box server, said access opening in said front panel providing access to the interior of said dispenser when assembled, and means on at least one of said panels for securing said dispenser when assembled from said carton blank to the bag in the box beverage server, whereby when said panels are folded and assembled, the assembled dispenser can be filled with at least one of a plurality of disposable stacks of beverage cups and other beverage accessories and secured to the bag in the box beverage server to provide neat and convenient service.

2. A folding carton blank as in claim 1, wherein said first and second side panels are of a width sufficient to accommodate one stack of cups, and said front and back panels are of a width sufficient to accommodate a plurality of stacks of cups and of the same height and width as the side of the bag in the box server.

3. A folding carton blank as in claim 2, wherein said access opening in said front panel is located so that about one-third of the surface of the first panel is above said access opening and two-thirds of the surface of said front panel is below said access opening, said front panel being substantially shorter than said side and back panels.

4. A folding carton blank as in claim 1, assembled to form said dispenser with said first side panel secured to said back panel by said first locking means on said first side panel engaging said cooperating locking means on said back panel, and a bottom being formed by interlocking said first, second, third and fourth bottom tabs.

5. A folding carton blank as in claim 4, further comprising a rectangular shelf tab on said front panel extending into said access opening, said shelf tab having a vertical dimension substantially that of the width of said side panels and a horizontal width that of said back panel, a fifth horizontal line between said shelf tab and said front panel, said shelf tab having a locking tab at its lower edge, and said back panel having a cooperating horizontal slot for receiving the same, said cooperating horizontal slot being located at substantially the same height as said fifth horizontal fold line, whereby a shelf may be formed by folding said shelf tab toward said back panel and engaging said locking tab in said horizontal slot.

6. A folding carton blank as in claim 5, further comprising upper divider means for dividing said shelf into one or more partitioned spaces.

7. A folding carton blank as in claim 5, further comprising lower divider means for dividing said space below said shelf into one or more partitioned spaces.

8. A folding carton blank as in claim 7, further comprising a security panel which is formed when said access opening is cut, said security panel being capable of being inserted into said access opening to substantially close the same so that beverage accessories therein are contained and for use as a drip shield.

9. A folding carton blank as in claim 5, wherein said means for securing said dispenser to said bag in the box type beverage server is capable of serving as a handle for the assembled beverage accessory dispenser.

* * * * *